US011400489B2

(12) United States Patent
Fransson et al.

(10) Patent No.: US 11,400,489 B2
(45) Date of Patent: Aug. 2, 2022

(54) SCREENING MEDIA FOR VIBRATORY SEPARATORS

(71) Applicant: SANDVIK INTELLECTUAL PROPERTY AB, Sandviken (SE)

(72) Inventors: Thomas Fransson, Trelleborg (SE); Mats Malmberg, Rydsgard (SE); Eskil Beckdahl, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 16/461,702

(22) PCT Filed: Aug. 29, 2017

(86) PCT No.: PCT/EP2017/071666
§ 371 (c)(1),
(2) Date: May 16, 2019

(87) PCT Pub. No.: WO2018/091157
PCT Pub. Date: May 24, 2018

(65) Prior Publication Data

US 2019/0358675 A1 Nov. 28, 2019

(30) Foreign Application Priority Data

Nov. 17, 2016 (WO) ..... PCT/EP2016/078003

(51) Int. Cl.
*B07B 1/48* (2006.01)
*B07B 1/46* (2006.01)

(52) U.S. Cl.
CPC ..... *B07B 1/4663* (2013.01); *B07B 1/469* (2013.01); *B07B 1/4672* (2013.01); *B07B 1/48* (2013.01)

(58) Field of Classification Search
CPC ..... B07B 1/4663; B07B 1/469; B07B 1/48; B07B 1/4672; B07B 1/4654
See application file for complete search history.

(56) References Cited

U.S. PATENT DOCUMENTS 1,561,632 A * 11/1925 Woodward ..... B07B 1/469 209/397
1,718,385 A * 6/1929 Sherwood ..... B07B 1/4672 427/247
2,082,513 A 6/1937 Eugene
2,181,859 A 12/1939 Baker et al.
(Continued)

FOREIGN PATENT DOCUMENTS

AU 6218873 A 5/1975
CN 111014029 A * 4/2020 ..... B07B 1/4618
(Continued)

*Primary Examiner* — Patrick H Mackey
(74) *Attorney, Agent, or Firm* — Corinne R. Gorski

(57) ABSTRACT

Screening media to screen oversized material includes a main body and a plurality of openings extending through the main body between an upward facing contact face and a downward facing bottom face. A textured pattern is provided at the contact face to provide a roughened surface for the partial entrapment of material fines. Such a configuration protects the screen media from aggressive contact with the material to be screened and provides a bedding layer that is maintained by material-on-material attrition during bulk material flow over the media.

12 Claims, 7 Drawing Sheets

(56) References Cited

U.S. PATENT DOCUMENTS

| | | | | | |
|---|---|---|---|---|---|
| 3,857,751 | A * | 12/1974 | Jacobs | B32B 3/266 | 428/217 |
| 3,900,628 | A * | 8/1975 | Stewart | B07B 1/469 | 428/134 |
| 4,575,421 | A | 3/1986 | Derrick | | |
| 4,600,622 | A * | 7/1986 | Carlson | B07B 1/469 | 428/131 |
| 5,330,057 | A | 7/1994 | Schiller et al. | | |
| 6,371,301 | B1 * | 4/2002 | Schulte | B01D 33/033 | 209/405 |
| 8,167,134 | B2 * | 5/2012 | Helmy | B07B 1/4672 | 209/401 |
| 2008/0067113 | A1 * | 3/2008 | Helmy | B07B 1/4672 | 209/405 |
| 2010/0300943 | A1 * | 12/2010 | Van Rensburg | C08J 11/04 | 209/397 |
| 2014/0021107 | A1 * | 1/2014 | Yaver | B07B 1/04 | 209/392 |
| 2016/0038976 | A1 * | 2/2016 | Moon | B07B 1/4672 | 209/397 |

FOREIGN PATENT DOCUMENTS

| | | | | |
|---|---|---|---|---|
| DE | 2122196 | A1 | 1/1972 | |
| DE | 8709909 | U1 | 9/1987 | |
| DE | 3721436 | A1 | 1/1989 | |
| GB | 754860 | A1 | 8/1956 | |
| RU | 1777970 | A1 | 11/1992 | |
| RU | 2094134 | C1 | 10/1997 | |
| RU | 2414967 | C2 | 3/2011 | |
| SU | 523628 | A3 | 7/1976 | |
| SU | 1098820 | A1 | 6/1984 | |
| SU | 1488022 | A1 | 6/1989 | |
| WO | WO-02074453 | A1 * | 9/2002 | B07B 1/4627 |
| WO | 201108970 | A1 | 9/2011 | |

* cited by examiner

SCREENING MEDIA FOR VIBRATORY SEPARATORS

RELATED APPLICATION DATA

This application is a § 371 National Stage Application of PCT International Application No. PCT/EP2017/071666 filed Aug. 29, 201 claiming priority to PCT/EP2016/078003 filed Nov. 17, 2016.

TECHNICAL FIELD

The present disclosure relates to a screening media for vibratory separators. More specifically, the present disclosure relates to a light and foldable tensioned rubber screening media with a textured pattern provided at an upward facing contact face to reduce frictional wear of the media.

BACKGROUND

Vibratory separators have been used commonly for various applications involving size-based segregation of material. One of the important applications of vibratory separators is found in mining and mineral processing industry where these separators or screening units, owing to the vibration of the screening media, separate the material fed on to them, into different grades based on the particle sizes. For this purpose, screening media is used, which has screening apertures through which stones smaller than the apertures, pass. Stones bigger than the screening apertures are transported from the top of the screening media and fed out at the end of the vibrating screen device. Commonly used screening media include mesh made of stainless steel, high carbon steel and oil-tempered steel wires.

While woven wire-mesh screening media are suitable for removal of "fines" and hence widely accepted in the industry, they also have several drawbacks. Excessive usage of wire-mesh screens result in the phenomenon referred to as "blinding", which causes material lodging into the screening apertures resulting in plugged openings and inefficient screening. To address this issue, periodic "brushing" needs to be done by the operator of the device to dislodge the material from the screening apertures. This causes downtime of the machine, resulting in loss of productivity.

Another major drawback of the wire-mesh media is the contamination with finer or oversized particles. Oversize contamination occurs when there is a hole in the screen which is larger than the mesh size of the screen. This happens due to wear and tear of the wire-mesh screening media, resulting in some apertures which are larger than the others. Similarly, fines contamination occurs when large sections of the screen cloth are blinded over, and material flowing over the screen does not fall through. This results in particles smaller than the desired size.

Yet another problem with excessive usage of wire-mesh screen media is "knuckling" which is the bending of wire in knuckle-like shapes resulting in impediment in normal flow of material as some particles hang on the knuckles and stretch the wire. The operator needs to check the tension of the wire periodically when "knuckling" arises, and tighten the mesh. This also causes loss in productivity due to machine downtime.

One major reason for stopping the machine is usually the wear and tear of the wire-mesh screen. This requires repair or replacement of the screen resulting in loss of productive time. Since there are usually no pre-indicators for damage to the screen, there is usually some particle size contamination encountered before screen is replaced.

Woven wire-mesh screens are also heavy to transport and noisy in operation. Sometimes the loose or worn-out wire ends may also injure the operator while carrying and installing the mesh, thereby resulting in occupational hazards.

U.S. Pat. No. 5,330,057 discloses a multi-layer composite screen cloth in which a wire-mesh that represents the uppermost contact face is formed from elongated wire elements manufactured with random longitudinal score marks so as to provide a general roughness to the contact face that is intended to improve conveyance and reduce the likelihood of blinding by the bulk material. However, such screening media has limited application in screening fine grade materials. Additionally, such media is disadvantageous due to its complex manufacturing and construction, along with being prone to wear and tear. Woven wire-mesh screens have been elaborated in patent document U.S. Pat. No. 4,575,421 too.

Several reinforced rubber variants of screening media are also used presently in the industry, which allow the screening media to be made thinner while providing it with a longer wear life. However, these new variants suffer with the disadvantage that it is difficult to detect wear on the screen. It is detected after the screen loses tension and breaks. It is thus required to develop a screening media with a wear-indication system which prevents losses by informing the operator in advance about any possible wear and tear on the screen.

Accordingly, there exists a need for a screening media which is free from any of the above-mentioned problems, easy and cost-effective to install and manufacture, free of hazards, light in weight, silent in operation, and wear-resistant. There is also a need for a system that can indicate in advance the wear and tear of the screen, and thus prevent contamination in the screened material.

BRIEF SUMMARY OF THE DISCLOSURE

The aim of the present disclosure is to overcome or at least reduce the above-mentioned problems.

It is an objective of the present disclosure to provide screening media configured to be self-protecting from abrasive wear without the need for one or a plurality of abrasion-resistant layers. The screening media is aimed to be resistant to wear by the continual abrasive contact with material flowing over the media. It is a further objective of the present disclosure to provide a screening media which is durable and easy and cost-effective to manufacture and install. It is a further specific objective to provide a screening media of reduced weight to facilitate storage, transportation and installation at a screen deck whilst being structurally robust so as to withstand abrasive contact with bulk material.

It is yet another objective of the present disclosure to provide a screening media which is stronger and has better hole tolerance and capacity than its wire-mesh counterparts. Still another objective of the present disclosure is to provide a screening media which provides wear-indication so that the operator can replace the screen before it is highly damaged.

The objectives are achieved by providing a screening media having a specifically configured contact face adapted to be self-protecting in use. In particular, the present screening media comprises a textured pattern at an upward facing contact surface configured to at least partially entrap 'fines' or smaller particulates of the material to be screened so at to build a protective bed or layer over the contact face. Advantageously, the textured contact face is adapted to be responsive to the magnitude of the abrasive contact with the material to be screened in that as the volume of material flowing over the bed increases, the protective material bed is continuously replenished, rebuilt and enhanced by the material flow.

According to a first aspect of the present invention there is provided screening media to screen material, the media comprising: a main body having a contact face intended to be upward facing to contact material to be screened and a bottom face intended to be downward facing, the main body having a thickness defined between the contact and bottom faces; a plurality of openings extending through the thickness of the main body between contact and bottom faces; characterised by: a repeating textured pattern provided at the contact face.

Reference within this specification to a 'repeating textured pattern' encompass a profiled surface having regions of different height including raised and recessed parts. This term encompasses texturing provided at a surface by any one or a combination of ridges, ribs, lumps, projections, protuberances, grooves, cavities, pimples or channels. This term also encompasses the pattern being a regular repeating pattern and not a random collection of raised or recessed regions so as to be generally consistent and uniform over the contact face.

Optionally, the main body comprises a single piece material, i.e. the main body may comprise at least a first layer and a second layer bonded or attached together to form a composite structure, the first layer defining the contact face and the second layer defining the bottom face. The main body comprising a multi-layer structure is advantageous to facilitate manufacturing. In particular, the multiple layers may be formed from different materials or material compositions that may be bonded or attached together by thermal bonding or mechanical attachment means such as pins, screws, rivets, bolts and the like. Where one of the material layers comprises a rubber or polymer material, the layers may be bonded by heat treating, heat pressing or vulcanization.

Preferably, the first layer comprises a first material and the second layer comprises a second material, a hardness of the first material being less than a hardness of the second material. Such a configuration is advantageous to facilitate manufacturing in that the textured pattern at the contact face may be formed conveniently by a 'branding' process at the contact surface involving heating the main body and pressing a mesh (or other suitable substrate) into the first layer so as to imprint a roughened profile formed from peaks and valleys (troughs) according to the shape profile of the mesh (or substrate) as it is removed from the first layer. Optionally, this process may involve heating the main body and/or the mesh or substrate. The first layer may then be bonded to the second layer by a further heat pressing stage. Optionally, the first material of the first layer may be formed from a polymeric material including rubber, polyurethane and the like. Optionally, the second material of the second layer may comprise a polyester, a polyamide, nylon, carbon fibre and the like. Where the first material of the first layer is a rubber, the first and second layers may be bonded by vulcanisation. Preferably, the branding process, as described, may form part of the vulcanisation process for a composite (multi-layer) structure (i.e., bonding of multiple layers) to avoid additional heating and pressing stages. Optionally, the first layer and the second layer may be attached together by thermal or chemical bonding (e.g., via an adhesive) or mechanical attachment such as by pins, bolts, rivets, screws and the like.

Preferably, the pattern is represented by peaks and troughs at the contact face, a depth of the pattern being defined as the separation distance between the peaks and troughs in a plane extending parallel to the thickness of the media. Optionally, the depth of the pattern is in a range 0.05 mm to 10 mm. Optionally, the pattern depth range is 0.1 mm to 8 mm or 0.2 mm to 5 mm. Such a configuration provides the desired pocket or cavity size at the textured contact face to build the protective bed of material that covers the screening media and accordingly facilitates material-on-material abrasive contact. Such a configuration is further beneficial to continuously rebuild the protective layer as fines or small particulates (that are capable of being entrapped between the peak and troughs) are created by the abrasive material-on-material attrition as the bulk material flows over the protective bed.

Such an effect ensures the screening media is continually protected and the desired wear resistance provided.

Preferably, a thickness of the first layer is greater than a thickness of the second layer. Optionally, a thickness of the second (reinforcement) layer is 5 to 50% of the first layer. Optionally, the thickness of the media between an uppermost part of the contact face and the bottom face is in the range 1 mm to 20 mm, 1 mm to 10 mm, 2 mm to 4 mm, 4 mm to 6 mm or 6 mm to 8 mm. Optionally, where the screening media comprises an upper first layer and lower second layer, the second layer (being of a higher hardness than the first layer) may comprise a thickness in the range 0.4 mm to 1.0 mm; 1.0 mm to 2.0 mm or 1.5 mm to 2.5 mm. Such configurations may comprise a single second layer, a dual second layer or three second layers respectively. The multiple second layers may be attached together by thermal or chemical bonding (e.g., via an adhesive) or mechanical attachment such as by pins, bolts, rivets, screws and the like.

Optionally, a width, length or diameter of each of the openings in a plane perpendicular to the thickness of the media is in a range 1 mm to 50 mm. The openings may comprise any shape profile including a polygonal shape profile, a square, rectangular, circular, or oval shape profile. Preferably, a cross sectional area of the openings in a plane perpendicular to the thickness of the media is generally uniform or increases through the thickness of the main body between the contact and bottom faces. Accordingly, the size of the openings may be generally uniform or may decrease through the thickness of the media such that a cross sectional area of the openings at the contact face may be approximately equal or may be less than the cross-sectional area of the openings at the bottom face. Such a configuration is advantageous to allow the unhindered passage of material of the desired particulate size through the media and reduce the likelihood of blinding (blockage) of the openings. In particular, where the screening media is formed as a multi-layer composite, the size of the openings are uniform or increase through the thickness of the media and in particular through each of the layers.

Preferably, at least first regions of the contact face are generally planar, said first regions representing peaks of the pattern that are raised relative to second regions representing troughs of the pattern. The generally flat contact surface into which the textured pattern is formed, is advantageous to provide a generally planar surface for the contact of the material flow. This provides generally uniform wear across the entire contact surface and facilitates the generally uniform building of the protective bed having a generally uniform thickness in a plane perpendicular to the material flow (corresponding to a thickness of the screening media). The peaks of the textured pattern may be formed by relatively sharp crests and the valleys (or troughs) may be formed by generally smooth, curved or rounded valleys extending between the crests. Optionally, the textured pattern is formed by imprinting a mesh or other substrate into the contact surface with the mesh being formed from a weave (e.g., a metal mesh) in which the warps and wefts comprise a generally circular cross sectional profile. Optionally, the warps and wefts may comprise a square or rectangular cross sectional profile so as to form corresponding square or rectangular shaped valleys and peaks. Preferably, the pattern extends over all or a majority of the contact face. Preferably, the regular repeating pattern extends over the entire contact face and in between the openings.

Optionally, a depth of the pattern represented by a separation distance between peaks and troughs of the pattern at the contact face is in a range 5% to 70% of a total thickness of the media between the bottom face and the peaks of the contact face.

The screening media has traditionally been made in a press or formed in a mould. The screening media described in the present disclosure is manufactured using the process of vulcanization on a rotating drum and reinforcing the media with polyester cloth followed by punching the holes on the media and cutting the media into suitable lengths of screening mats according to the dimensions of the tensioning devices over which they will be secured. The screening apparatus comprises of a support frame, support beams, clamp bars, tensioning devices, and rubber cappings. The media is held in place over the screen deck by the use of clamp bars. It is either cross-tensioned or longitudinally tensioned.

Another aspect of the present disclosure, is to forewarn the operator about wear and tear of the screening media. The fabric beneath the rubber layer is colored in a color different from the top rubber layer and thus if the screen media is torn, the second layer gets exposed and serves as an indication for repair or replacement of the screen.

The rubber used for the screening media is manufactured by the rotating drum vulcanization process. The grades of rubber that can be used for this purpose include but are not limited to SBR, NR and BR. The rubber employed for the screening media must have a hardness in the range of 40 to 70 Shore A.

The present disclosure aims to provide an efficient screening media which allows classification of material having a broad range of particle size. While this media is able to separate fine particles like wire-mesh, it does not suffer from any of the drawbacks of said wire-mesh. It is an object of the present disclosure to provide a tensioned screening media assembly which does not undergo blinding or pegging due to excessive usage, is less noisy in operation compared to its metallic wire-mesh counterparts, is easy and safe to install and operate, has a longer operational life and does undergo "knuckling", and is cost effective. Additionally, the present disclosure also aims to alert the operator in advance of any kind of wear and tear on the screening media owing to the differently coloured reinforcing fabric layer in the rubber screening media. If the top layer wears out, the different color of the reinforcing fabric layer is an indication to replace the screening media to avoid further losses.

Other aspects and advantages of the present disclosure will be more apparent from the following description, which is not intended to limit the scope of the present disclosure.

BRIEF DESCRIPTION OF THE DRAWINGS

The present disclosure will now be explained in relation to the accompanying drawings in which.

DETAILED DESCRIPTION OF THE DRAWINGS

The present disclosure will now be described with reference to the accompanying embodiments which do not limit the scope and ambit of the disclosure. The description provided is purely by way of example and illustration. The examples used herein are intended merely to facilitate an understanding of ways in which the embodiments herein may be practiced. Accordingly, the examples should not be construed as limiting the scope of the embodiments herein.

The present disclosure provides a solution to the above stated problems in presently used woven wire-mesh screens by envisaging a screening media to screen material, the media comprising:

a main body having a contact face intended to be upward facing to be in contact with the material to be screened and a bottom face intended to be downward facing, the main body having a thickness defined between the contact and bottom faces made with first layer material and a second layer material. This main body has a plurality of openings extending through the thickness of the main body between the contact and bottom faces.

The first layer material may be bonded or attached together with the second layer material to form a composite structure. The first layer may have a textured pattern on the surface to prevent wear and tear, according to one of the embodiments of the present disclosure. The second layer is preferably reinforced with fabric which in addition to strengthening the screening media, also acts as a wear-indicator owing to the color of the fabric which gets exposed when the top layer gets torn, according to one of the embodiments of the present disclosure.

Figure 1:
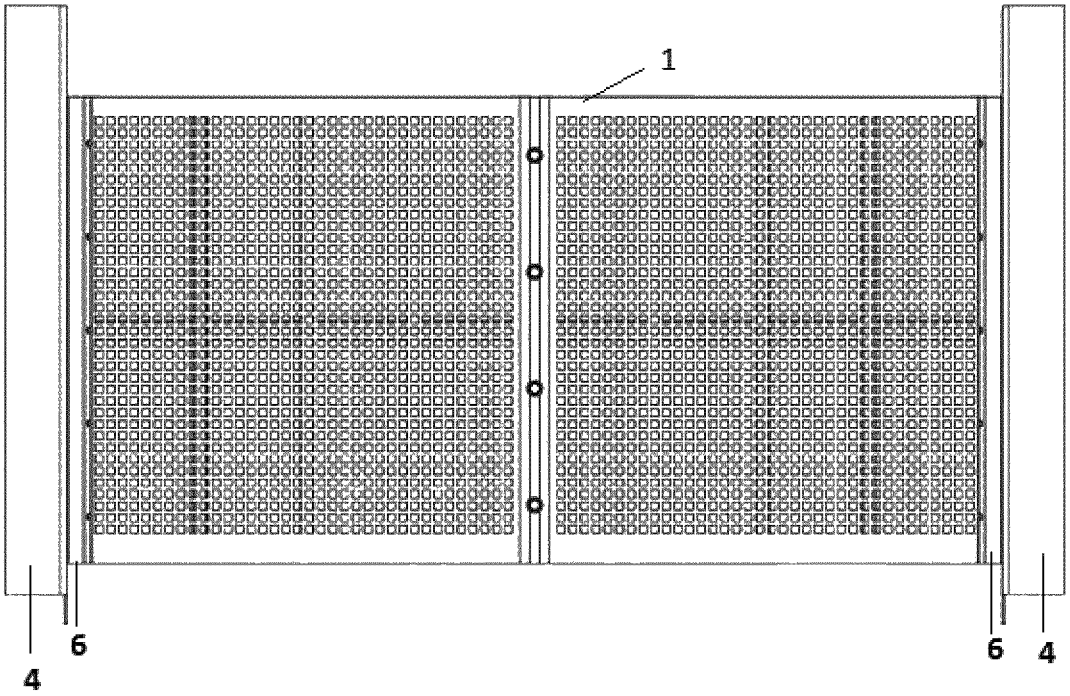
FIG. 1 illustrates the top view of the screen assembly according to one of the preferred embodiments of the present disclosure.
Figure 2:
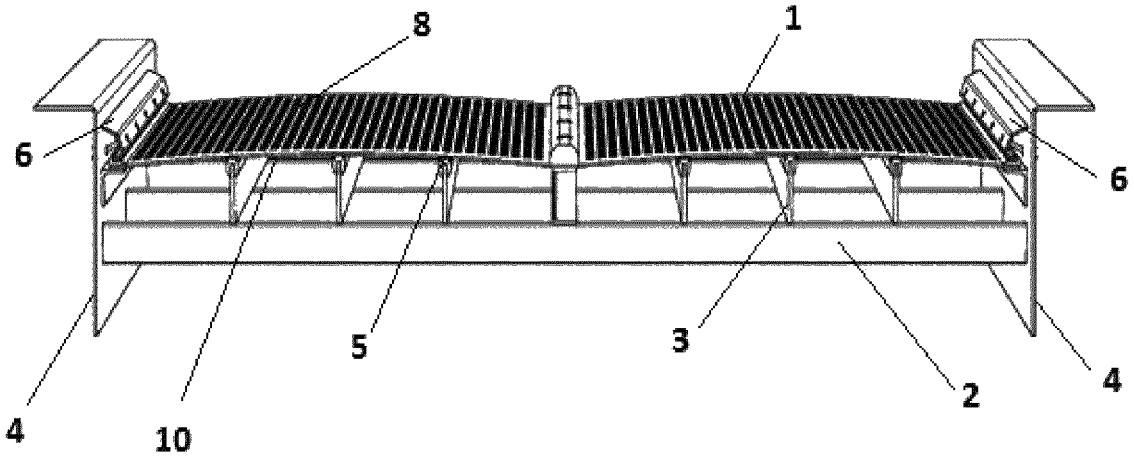
FIG. 2 illustrates the perspective view of the screen assembly according to one of the preferred embodiments of the present disclosure

Referring to FIGS. 1 and 2, the top and perspective view of the screen assembly are illustrated respectively. The screening media 1 is secured over the support frame 2 with the help of support beam 3. The screening media 1 can be stretched across the support frame 2 in cross-tensioned or longitudinally tensioned fashion between a pair of side walls 4. Media 1 is supported at its underside by a plurality of lengthwise extending support beams 3 and clamped on to the sidewalls 4 by clamp bars 6. The screening media 1 is held down at the centre of the screen assembly to tighten and stretch it optimally. The screen assembly also uses rubber capping 5 to prevent the screen media from wear.

Figure 3:
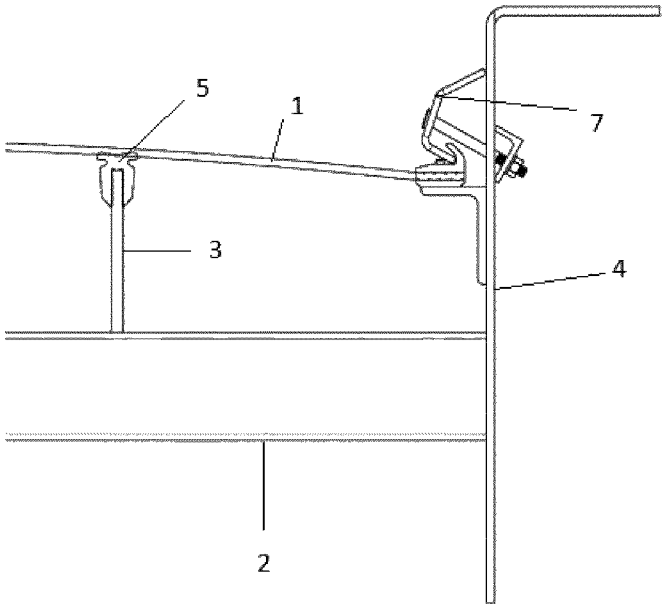
FIG. 3 illustrates the enlarged side view of the screen assembly showing screening media clamped to the screening apparatus using a tensioning device according to one of the preferred embodiments of the present disclosure.

Referring to FIG. 3, the enlarged side view of the screen assembly is seen, where the screening media 1 is shown to be clamped to the side wall 4 with the help of a tensioning device 7. The tensioning device 7 seen in the figure, are made of aluminium according to one of the embodiments of the present disclosure. These tensioning devices 7 are structured based on the method of tensioning. They may be designed differently for cross-tensioned and longitudinally tensioned screen cloths. The screening media 1 is held down at the centre of the screen assembly to tighten and stretch it optimally. The screen assembly also uses rubber capping 5 to prevent the screen media from wear.

Figure 4:
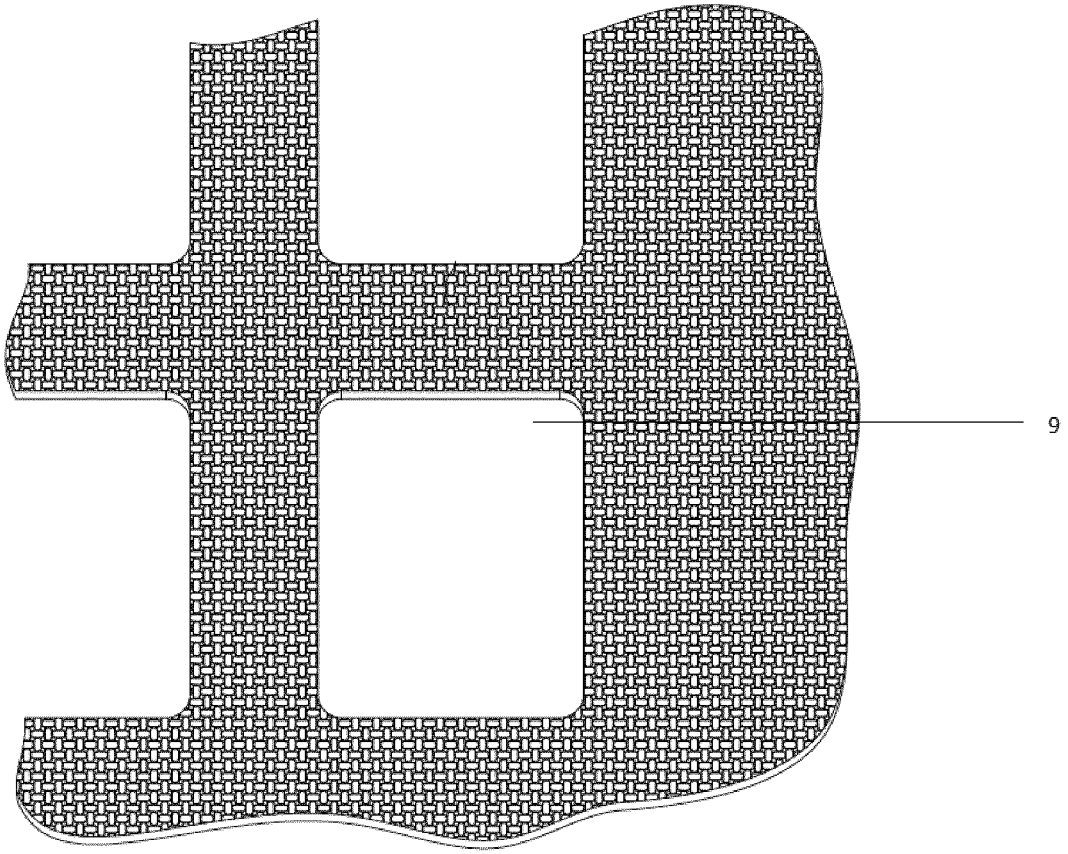
FIG. 4 illustrates the enlarged view of the screening media according to one of the preferred embodiments of the present disclosure.

Referring to FIG. 4, a section of the screening media mat is enlarged and shown. It is visible from the figure that a plurality of screening apertures 9 extend through the thickness of the media. The screening apertures 9 punched into the screening media may be of any shape. The preferred shape for fine screening application is square. These squares may be punched in-line or staggered against each other. The dimension, shape and orientation of the punched screening apertures 9 depend on the application and the particle size of the material which is to be screened. According to one of the embodiments of the present disclosure the screening media 1 has rectangular screening apertures 9 punched into it. The alignment of the screening apertures 9 is chosen on the basis of the requirement of the screening operation.

Figure 5A:
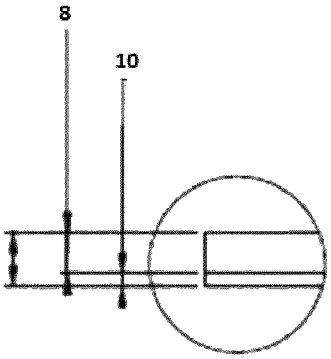
FIGS. 5A, 5B and 5C illustrate the enlarged view of the cross-section of screening media according to one of the preferred embodiments of the present disclosure
Figure 5B:
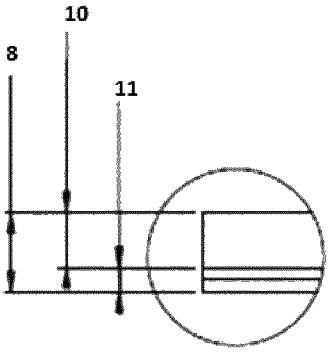
Figure 5C:
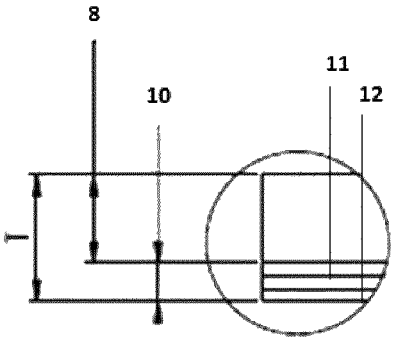

Referring to FIGS. 5A, 5B and 5C, the cross-sectional view of the screening media 1 illustrates the layers constituting the screening media 1. According to one of the preferred embodiments of the disclosure, the screening media 1 comprises of at least one layer of rubber 8 over at least one layer of fabric-reinforced rubber 10. These two layers are clearly visible in FIG. 5A. In FIG. 5B, two layers 10 and 11, can be seen below the top layer 8. Similarly FIG. 5C shows three layers 10, 11 and 12 below the top layer 8. The more the number of layers, more is the reinforcement and more is the strength of the screening media. The fabric used for reinforcement may be selected from a range of polyesters, polyamides, nylon or carbon fibres. The reinforcement of fiber must have the same characteristics of both warp and weft, that is the same e-module. The top layer 8 is preferably made using rubber or polyurethane materials. Some examples of commonly used rubber grades are SR, NBR and BR. For applications inducing high wear and tear, it is recommended that the rubber used for screening media 1 has the hardness in the range of 40 to 70 shore A. The second layer 10 is rubber reinforced with fabric to add strength to the screening media 1. To reinforce, the fibres of the fabric are integrated in the rubber or polymeric material at the time of extrusion. Reinforcement of the screening media 1 allows the screen assembly to take bigger load without yielding, and thus allows for decrease in the thickness of the screening media 1 making it lighter and easier to transport than its wire-mesh counterparts. Post-reinforcement, it is also possible to decrease the amount of material between the openings of the screening media 1, thereby increasing the total open area of the screening media 1. Therefore, reinforcement of screening media 1 results in its increased efficiency and dimensional stability.

Figure 6:
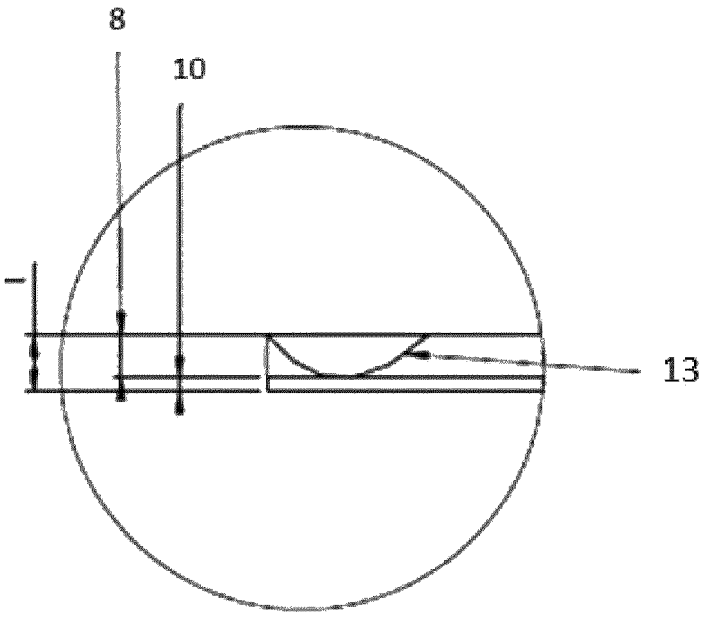
FIG. 6 illustrates the enlarged view of the cross-section of screening media according to one of the preferred embodiments of the present disclosure when the top layer is torn and the reinforced fabric layer is seen as wear indicator.

Further observed in the FIG. 6, is that the top layer 8 is torn due to wear and tear. The torn top layer 8 exposes the fabric-reinforced rubber layer 10 beneath it. Since the layer 10 is differently colored than the top rubber layer 8, it works like a wear-indicator to forewarn the operator about the wear and tear of the screen, so that it can be replaced before greater damage is caused. The torn portion 13 is indicative of the wear.

Figure 7A:
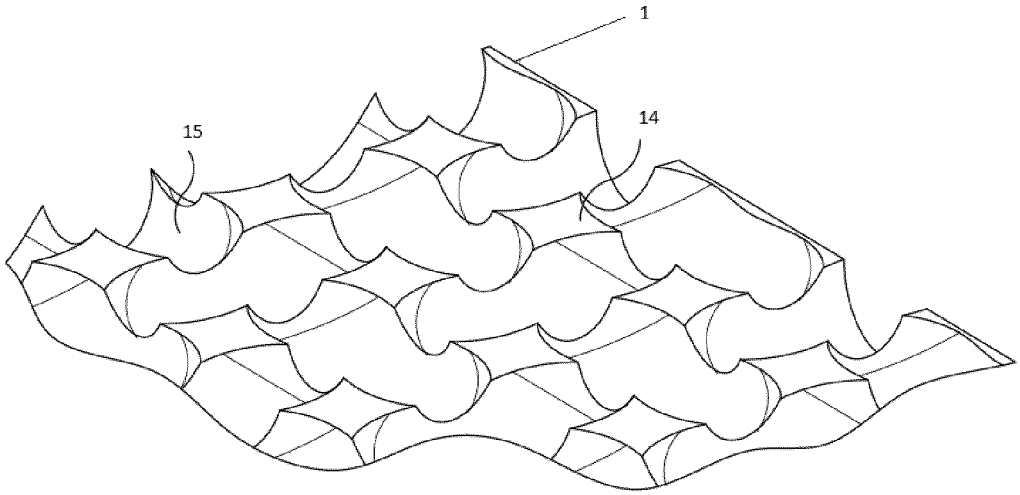
FIG. 7A illustrates a magnified view of the contact face of the screening media having a textured pattern formed by peaks and troughs according to a specific implementation of the present invention and 7B shows a side elevation end view of the textured pattern at the contact face of FIG. 7A.
Figure 7B:
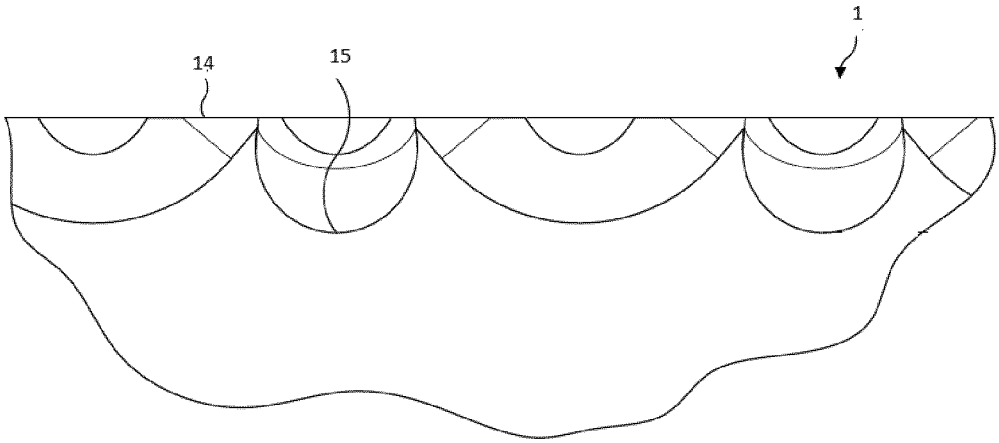

Referring to FIGS. 7A and 7B, the textured pattern on the surface of the screening media 1 can be observed. According to the specific implementation, the textured pattern extends over the entire surface of the top layer. The textured pattern is formed from peaks 14 and respective troughs 15 that collectively define a repeating pattern. The textured pattern may be created conveniently by pressing a woven mesh (or other substrate) into the first layer 8 (when formed from a rubber material) as part of the vulcanisation process. Once the mesh is removed, an imprinted pattern is formed corresponding to the shape profile of the woven mesh so as to define the peaks 14 and troughs 15. The shape of the textured pattern at the surface of the top layer 8 may be achieved by selecting the appropriate dimensions and cross sectional shape profile of the warps and wefts of the imprinting mesh. According to the specific implementation, the textured pattern at the surface of the top layer is formed by troughs 15 that are continuously curved which are in turn formed by the wefts and warps having a generally circular cross sectional profile.

The relative depth of the textured pattern (defined as the separation distance between the peaks 14 and troughs 15 in a plane perpendicular to the plane of the media 11) is much less than the total thickness of the media 1 and the thickness of the top layer 8. Such a configuration provides a surface roughness whilst ensuring that the top layer 8 comprises sufficient thickness to achieve the desired structural strength of the media 1 capable of being pre-tensioned between sidewalls 4. In particular, the depth of the trough 15 may extend in a range 5% to 50% of thickness of the top layer 8.

The rubber for the screening media is manufactured using an automatic mat vulcanizing system (AUMA) which involves the use of a slow-rotating steam-heated drum under controlled pressure conditions. The rubber media thus produced is reinforced with a polyester or a polyamide fabric which has a color different from the color of the rubber. The reinforced media is then punched into, to make screening apertures of desired shape. Thereafter, it is cut into pieces of desired length as per the requirement. The screening media thus prepared, is then installed on the cambered screen decks of the screening unit. The screen decks are cambered to prevent the screening media from flapping during the operation which can lead to breaking of the screening media. The screening media is secured over the tensioning device using clamp bars and tensioning devices for example made of aluminium, either in a cross-tensioned or longitudinally tensioned fashion. There is capping of rubber provided under the screening media to protect it from wearing.

The present disclosure offers a host of advantages over its wire-mesh predecessors. The tensioned rubber media reinforced with fabric is stronger and more durable and therefore requires fewer media changes resulting in lower screen downtime. This screening media also has better hole tolerance, and increased capacity since owing to better durability, it allows more holes to be punched into it. It is free from the problems of blinding and pegging which are frequently encountered in woven wire-mesh screens. Hence, it provides better sizing accuracy even for fine particles (close to 2 mm particle diameter). There is almost no oversize or fines contamination in the screened product and consistent particle size range is maintained during the course of operation of the screen. As the screening media is durable and less prone to wear and blinding, there are fewer operational stops for inspection and troubleshooting. The media needs to be replaced much less frequently as compared to the woven wire-mesh screens. Along with the functional advantages, the screening media also offers benefits of easy and quick installation, and cost-effective production, thus ensuring long-term media economy. The screening media 1 is smooth, light and flexible and can be conveniently stored and transported in the form of a roll providing the user with the advantage of greatly simplified handling. It has no sharp edges like woven wire mesh and is therefore not hazardous for the operator carrying and installing the screening media. Since it is made of rubber, it does not make as much noise as metallic wire-mesh during the vibratory operations. The textured pattern on the surface of the top layer 8 provides the desired wear-resistance to the screening media 1.

In addition to these advantages, the tensioned rubber screening media 1 with reinforced fabric layer of a color different from the top rubber layer, offers the novel feature of wear-indication to the operator. If the top layer gets worn due to excessive usage, the layer beneath it starts showing and is easily observed by the operator since it is of a different, preferably contrasting colour. At this indication, the operator can replace the screening media before any more losses are incurred due to screen breakage.

The present disclosure has a wide range of applications in the industry. It is an all-round screening media designed primarily for final and intermediate screening in both wet and dry applications including but not limited to mining, mineral processing, construction, metallurgy and recycling industries.

We claim:

1. A screening media arranged to screen material, the media comprising:

a main body having a contact face of a top layer arranged to be upward facing to contact material to be screened and a bottom face of a second layer arranged to be downward facing, wherein a repeating textured pattern is provided along the top layer, the main body having a thickness defined between the contact and bottom faces, wherein the main body includes a top layer material and a second layer material; and a plurality of spaced screening apertures extending through the thickness of the main body between the contact and bottom faces, wherein the top layer material is bonded or attached together with the second layer material to form a composite structure in which the top layer material has one material characteristic and the second layer material has another material characteristic being different from the top layer material characteristic, wherein the second layer material is material reinforced with fabric fibres integrated in the material, wherein a warp and weft of fibres have a same characteristic, wherein strength and durability rendered by the fabric reinforced second layer material generates a dimension tolerance and capacity to the apertures when being punched out of the media, a size of the plurality of apertures being uniform through the thickness of the media such that a cross sectional area of the openings at the contact face is approximately equal to the cross-sectional area of the openings at the bottom face.

2. The media as claimed in claim 1, wherein the top layer material is vulcanized rubber and the second layer material is vulcanized rubber and reinforced fabric.

3. The media as claimed in claim 1, wherein the second layer is reinforced with fabric selected from the group consisting of polyesters, polyamides, nylon and carbon fibres.

4. The media as claimed in claim 1, wherein the second layer is reinforced with fabric having more than one layer.

5. The media as claimed in claim 1, wherein the second layer which is reinforced with fabric, has a color different from a color of the top layer.

6. The media as claimed in claim 1, wherein a shape of said screening apertures is selected from the group consisting of a quadrangle, circle, oval and triangle.

7. The media as claimed in claim 1, wherein the top layer is adhered to the second layer by a primer.

8. The media as claimed in claim 1, wherein said screening media is cross-tensioned between a pair of sidewalls perpendicular to a direction of a movement of material being screened.

9. The media as claimed in claim 1, wherein said screening media is longitudinally tensioned between a plurality of tensioning devices in a same direction as of a movement of material being screened.

10. A screening apparatus arranged to screen bulk material, the apparatus comprising:

a support frame;

a plurality of support beams;

at least one pair of sidewalls;

a plurality of clamp bars;

a plurality of tensioning devices; and a screening media as claimed in claim 1 mounted on the plurality of support beams and extended between the sidewalls, wherein said screening media is cross-tensioned between the respective sidewalls perpendicular to a direction of a movement of material being screened.

11. A screening apparatus arranged to screen bulk material, the apparatus comprising:

a support frame;

a plurality of support beams;

at least one pair of sidewalls;

a plurality of clamp bars;

a plurality of tensioning devices; and a screening media as claimed in claim 1 mounted on the plurality of support beams and extended between the sidewalls, wherein said screening media is longitudinally tensioned between of respective tensioning devices in a same direction as that of a movement of material being screened.

12. A method of fabrication of a screening media comprising the steps of:

providing a screening media, the screening media including a main body having a contact face of a top layer arranged to be upward facing to contact material to be screened and a bottom face of a second layer arranged to be downward facing, the main body having a thickness defined between the contact and bottom faces, wherein the main body includes a top layer material and a second layer material, wherein the top layer material is vulcanized rubber and the second layer material is vulcanized rubber and reinforced fabric punching the screening media to create a plurality of spaced screening apertures extending through the thickness of the main body between the contact and bottom faces and providing a repeating textured pattern provided along the top layer, wherein the top layer material is bonded or attached together with the second layer material to form a composite structure in which the top layer material has one material characteristic and the second layer material has another material characteristic being different from the top layer material characteristic, wherein the second layer material is material reinforced with fabric fibres integrated in the material, wherein a warp and weft of fibres have a same characteristic, wherein strength and durability rendered by the fabric reinforced second layer material generates a dimension tolerance and capacity to the apertures when being punched out of the media, a size of the plurality of apertures being uniform through the thickness of the media such that a cross sectional area of the openings at the contact face is approximately equal to the cross-sectional area of the openings at the bottom face;

providing an apparatus including a support frame, a plurality of support beams, at least one pair of sidewalls, a plurality of clamp bars, and a plurality of tensioning devices;

mounting the screening media on the plurality of support beams and extending between the sidewalls, wherein the screening media is cross-tensioned or longitudinally tensioned between the sidewalls; and cutting the screening media into screen mats according to a size of the screening apparatus.

* * * * *